US011634288B2

(12) United States Patent
Okamoto et al.

(10) Patent No.: US 11,634,288 B2
(45) Date of Patent: Apr. 25, 2023

(54) TRAY SWINGING MECHANISM AND DEVICE INCLUDING THE SAME

(71) Applicant: Brother Kogyo Kabushiki Kaisha, Nagoya (JP)

(72) Inventors: Yoshihiro Okamoto, Komaki (JP); Tomoyuki Mizuno, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 55 days.

(21) Appl. No.: 17/131,116

(22) Filed: Dec. 22, 2020

(65) Prior Publication Data

US 2021/0198059 A1 Jul. 1, 2021

(30) Foreign Application Priority Data

Dec. 26, 2019 (JP) ..... JP2019-237533

(51) Int. Cl.
*B65H 1/14* (2006.01)
*B65H 3/06* (2006.01)
*B65H 29/50* (2006.01)

(52) U.S. Cl.
CPC ..... *B65H 1/14* (2013.01); *B65H 3/0669* (2013.01); *B65H 3/0684* (2013.01); *B65H 29/50* (2013.01); *B65H 2301/4212* (2013.01); *B65H 2403/53* (2013.01); *B65H 2404/1421* (2013.01)

(58) Field of Classification Search
CPC ..... B65H 1/14; B65H 2406/512; B65H 2403/512
See application file for complete search history.

(56) References Cited

U.S. PATENT DOCUMENTS 5,443,252 A * 8/1995 Morinaga ..... B65H 1/08 271/127
6,042,103 A * 3/2000 Yraceburu ..... B65H 1/14 271/118
7,267,335 B2 * 9/2007 Kubo ..... B65H 1/14 271/127
8,794,618 B2 8/2014 Kondo
9,315,347 B2 * 4/2016 Hamada ..... B65H 1/14
10,737,896 B2 8/2020 Ito
(Continued)

FOREIGN PATENT DOCUMENTS

DE 3013605 A1 * 10/1980
JP H05-039131 A 2/1993
(Continued)

*Primary Examiner* — Howard J Sanders
(74) *Attorney, Agent, or Firm* — Banner & Witcoff, Ltd.

(57) ABSTRACT

According to aspects of the present disclosure, there is provided a tray swinging mechanism including a document tray. A movable plate of the document tray is configured to be swingable about a tray shaft and extends leftward. A lifter is configured to be swingable about a lifter shaft extending in the front-rear direction at a position different from the tray shaft. On a lower surface of the movable plate, a cam surface configured to contact a tip of the lifter is formed. The cam surface includes a parallel part parallel to an upper surface of the movable plate and a curved part spaced from the upper surface farther toward a right side. According to a shape of the cam surface, each time the lifter is rotated by a particular angle, the tip of the movable plate moves by a particular amount.

11 Claims, 7 Drawing Sheets

(56) References Cited

U.S. PATENT DOCUMENTS

| | | | |
|---|---|---|---|
| 2009/0295065 | A1 | 12/2009 | Kondo |
| 2019/0233225 | A1 | 8/2019 | Ito |
| 2020/0361736 | A1 | 11/2020 | Ito |

FOREIGN PATENT DOCUMENTS

| | | | |
|---|---|---|---|
| JP | H10-297771 | A | 11/1998 |
| JP | 2009-286517 | A | 12/2009 |
| JP | 2011-126686 | A | 6/2011 |
| JP | 2019-134273 | A | 8/2019 |

* cited by examiner

TRAY SWINGING MECHANISM AND DEVICE INCLUDING THE SAME

CROSS-REFERENCE TO RELATED APPLICATIONS

This application claims priority under 35 U.S.C. § 119 from Japanese Patent Application No. 2019-237533 filed on Dec. 26, 2019. The entire subject matter of the application is incorporated herein by reference.

BACKGROUND

Technical Field

The present disclosures relate to a tray swinging mechanism and a device including the same.

Related Art

Conventionally, there has been known an image scanning device provided with an auto document feeder (ADF). The ADF includes a document tray configured to support multiple document sheets in a stacked manner and a pickup roller arranged to contact an upper surface of an uppermost document sheet stacked on the document tray. When the pickup roller is rotated, the uppermost document sheet which contacts the pickup roller is fed into a housing and conveyed along a conveying path by rotation of a conveying roller arranged inside the housing.

SUMMARY

There is known an ADF employing a swingable tray as the document tray to increase the stackable number of document sheets on the document tray. The swingable tray is configured such that a part of the document tray on a downstream side in a conveying direction or the entire document tray is swingable about a swing shaft arranged at an upstream side of the document tray in the conveying direction, and the part of or the entire document tray is swung by a swinging mechanism having a lever or a cam.

In the swinging mechanism employing the lever (hereinafter, referred to a lever-type swinging mechanism), the lever is provided to be swingable about a swing shaft arranged parallelly to the swing shaft of the document tray and configured to push up the document tray from below by a tip of the lever. According to this configuration, since the swing shaft of the document tray and the swing shaft of the lever are arranged at different positions, even when the lever is swung by the same angle, a moving amount of the document tray (i.e., a rotation amount of the document tray per a constant rotation amount of the lever) varies depending on the rotational position of the lever. Therefore, a contacting pressure between the document sheets stacked on the document tray and the pickup roller may vary depending on the rotational position of the lever, and a feeding operation of the document sheets may become unstable.

The swinging mechanism employing a cam is configured such that, for example, a widthwise central part of the document tray is urged toward the pickup roller by a spring, and a widthwise side part of the document tray is pushed down by the cam. With this configuration, although the above-described disadvantage of the lever-type swinging mechanism would be overcome by devising a shape of the cam, since a load from the spring and a load from the cam are applied to the tray at different positions, the tray may by deformed over time.

According to aspects of the present disclosures, there is provided a tray swinging mechanism provided to a device having a main body, a tray being swingably supported by the main body with a first shaft, the tray extending from the first shaft toward a downstream side in a conveying direction which is perpendicular to the first shaft, the tray having a first surface on which document sheets are stacked and a second surface which is a surface opposite to the first surface, and a pickup roller configured to contact the document sheets stacked on the tray to feed the document sheets toward the downstream side in the conveying direction. The tray swinging mechanism including a lever swingably supported by the main body with a second shaft extending parallelly to the first shaft at a position different from a position of the first shaft, and a driving source configured to generate a driving force to swing the lever. The tray includes at least one cam surface formed on the second surface, and the cam surface is configured to contact a tip of the lever. The at least one cam surface is formed such that, at every swinging movement of the lever by a particular constant angle, a moving amount of a tip of the tray is constant when the lever is swung by a particular angle, the at least one cam surface being arranged within a range where the pickup roller extends in an axial direction of the first shaft.

According to aspects of the present disclosures, there is provided a device including a main body, a tray being swingably supported by the main body with a first shaft, the tray extending from the first shaft toward a downstream side in a conveying direction which is perpendicular to the first shaft, the tray having a first surface on which document sheets are stacked and a second surface which is a surface opposite to the first surface, a pickup roller configured to contact the document sheets stacked on the tray to feed the document sheets toward the downstream side in the conveying direction, a lever swingably supported by the main body with a second shaft extending parallelly to the first shaft at a position different from a position of the first shaft, and a driving source configured to generate a driving force to swing the lever. The tray includes at least one cam surface formed on the second surface, and the cam surface is configured to contact a tip of the lever. The at least one cam surface is formed such that, at every swinging movement of the lever by a particular constant angle, the tip a moving amount of a tip of the tray resulting from swinging of the lever by a particular angle is constant, the at least one cam surface being arranged within a range where the pickup roller extends in an axial direction of the first shaft.

BRIEF DESCRIPTION OF THE ACCOMPANYING DRAWINGS

DETAILED DESCRIPTION OF THE EMBODIMENT

Hereinafter, an illustrative embodiment according to aspects of the present disclosures will be described, referring to the accompanying drawings.

Document Feeder

Figure 1:
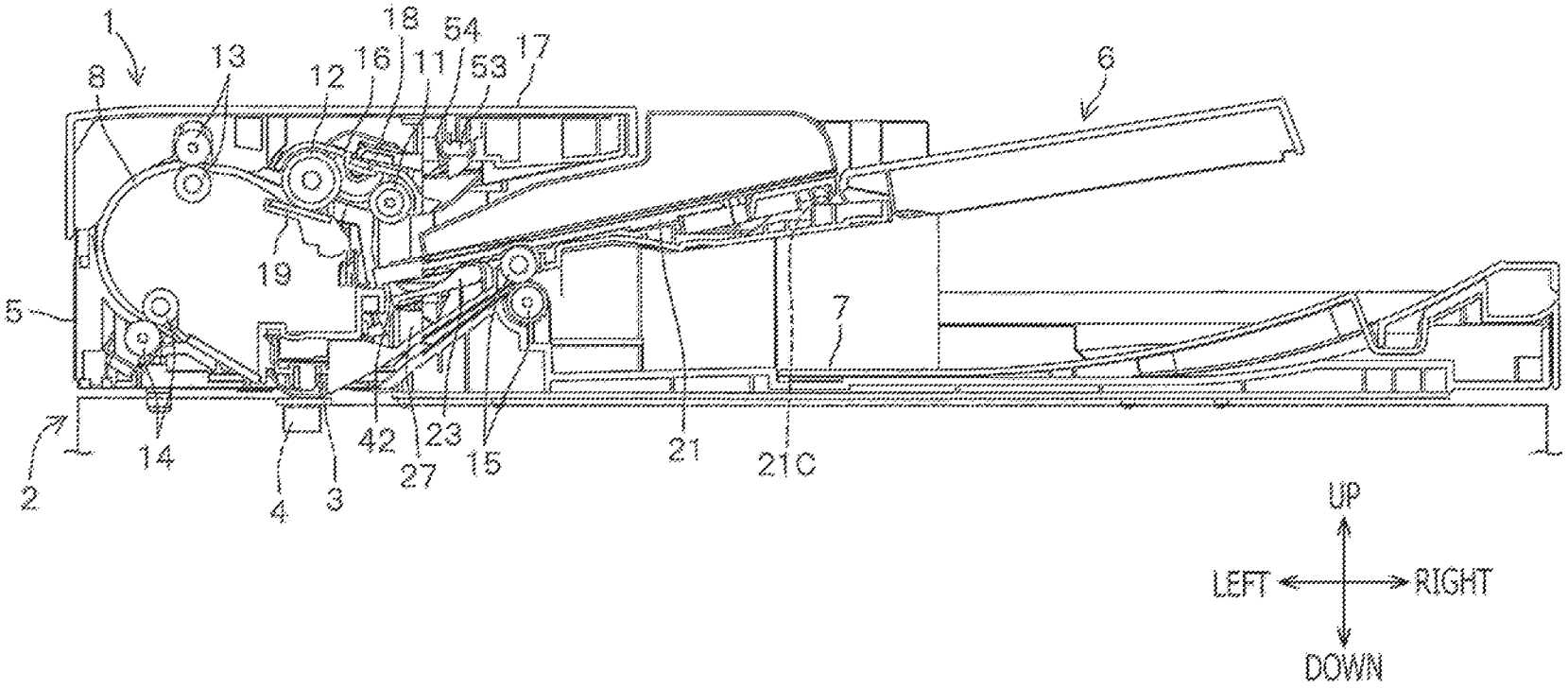
FIG. 1 is a cross-sectional view of a document feeder employing a tray swinging mechanism according to the present disclosures and indicates a state where a movable plate of a document tray is located at a starting position.

As shown in FIG. 1, a document feeder 1 is attached to an image scanning device 2 and configured to feed document sheets to be scanned onto a contact glass 3 provided on an upper surface of the image scanning device 2. Below the contact glass 3, a scanning device 4 is arranged. The scanning device 4 accommodates a light source, an image sensor, and the like. For example, the image sensor includes a linear image sensor in which multiple light receiving elements are arranged in a main scanning direction.

The document feeder 1 includes a housing 5 (an example of a main body). A document tray 6 and a discharge tray 7 are provided to the housing 5. The document tray 6 and the discharge tray 7 are arranged to overlap each other when viewed along a vertical direction with a clearance therebetween. A part of each of the document tray 6 and the discharge tray 7 is inserted inside the housing 5, while a remaining part of each of the document tray 6 and the discharge tray 7 is exposed outside from the housing 5. Each of the document tray 6 and the discharge tray 7 is configured to support the multiple document sheets having sheet shapes in a stacked manner.

A conveying path 8 is formed inside the housing 5. One end of the conveying path 8 is opened toward the document tray 6. The conveying path 8 extends toward a side opposite to the document tray 6, is curved downward and folded back to extend toward the discharge tray 7. The other end of the conveying path 8 is opened toward the discharge tray 7. The conveying path 8 extends such that a portion thereof on the discharge tray 7 side with respect to the curved and folded-back portion passes above the contact glass 3.

Along the conveying path 8, a pickup roller 11, a separating roller 12, a first conveying roller 13, a second conveying roller 14 and a discharging roller 15 are arranged in this order from the original tray 6.

The pickup roller 11 and the separating roller 12 are arranged in the vicinity of an entrance of the conveying path 8 such that the pickup roller 11 and the separating roller 12 are closely aligned in the conveying direction of the document sheets in the vicinity of the entrance of the conveying path 8. The pickup roller 11 is supported by a roller holder 16, and the separating roller 12 is supported by a frame (not shown) of the housing 5. The roller holder 16 is supported to be swingable about a shaft of the separating roller. Between the roller holder 16 and a cover 17 arranged above the roller holder 16 with space, an elastic member 18 is provided. When the roller holder 16 moves closer than a particular distance to the cover 16 and the roller holder 16 urges the elastic member 18, a reaction force to move the roller holder 16 away from the cover 17 is applied, by the elastic member 18, to the roller holder 16.

Further, the pickup roller 11 is arranged at a position where the pickup roller 11 can contact a top surface of an uppermost one of the document sheets stacked on the original tray 6 from above. When the pickup roller 11 is rotated, the uppermost document sheet contacting an outer circumference of the pickup roller 11 is conveyed toward the separating roller 12, and the uppermost document sheet is inserted between the separating roller 12 and a separating pad 19 contacting an outer circumference of the separating roller 12. When a plurality of the document sheets is inserted between the separating roller 12 and the separating pad 19, they are separated so that only one of document sheets is inserted into the conveying path 8 at one time. The document sheet inserted into the conveying path 8 is conveyed in the conveying path 8 as the conveying forces are applied by the first conveying roller 13, the second conveying roller 14 and the discharging roller 15, and the document sheet is discharged on the discharge tray 7 by the discharging roller 15.

In the image scanning device 2, when the document sheet passes over the contact glass 3, an image on a contacting surface of the document sheet on the contact glass 3, is scanned by the scanning device 4. That is, when the document sheet passes over the contact glass 3, a light emitted from the light source illuminates a target surface of the document sheet to be scanned. The image sensor of the scanning device 4 is configured to receive reflected light from the target surface and output an analog image signal for a single scanning line. Scanning of the image on the target surface is achieved by conveying the document sheet and sequentially scanning the image on the scanning target surface line-by-line from an upstream end to a downstream end in a sub-scanning direction being a conveying direction.

Hereinafter, the main scanning direction is defined as a "front-rear direction" of the document feeder 1, an upstream side in the conveying direction, on the contact glass 3, of the document sheet is defined as a "left side," and a downstream side in the conveying direction on the contact glass 3 is defined as a "right side." An "up-down direction" of the document feeder 1 is a direction perpendicular to both the front-rear direction and the right-left direction, and the document feeder 1 is installed horizontally in use. Further, each component will be described based on a state in which each component is provided to the document feeder 1.

Document Tray

Figure 2:
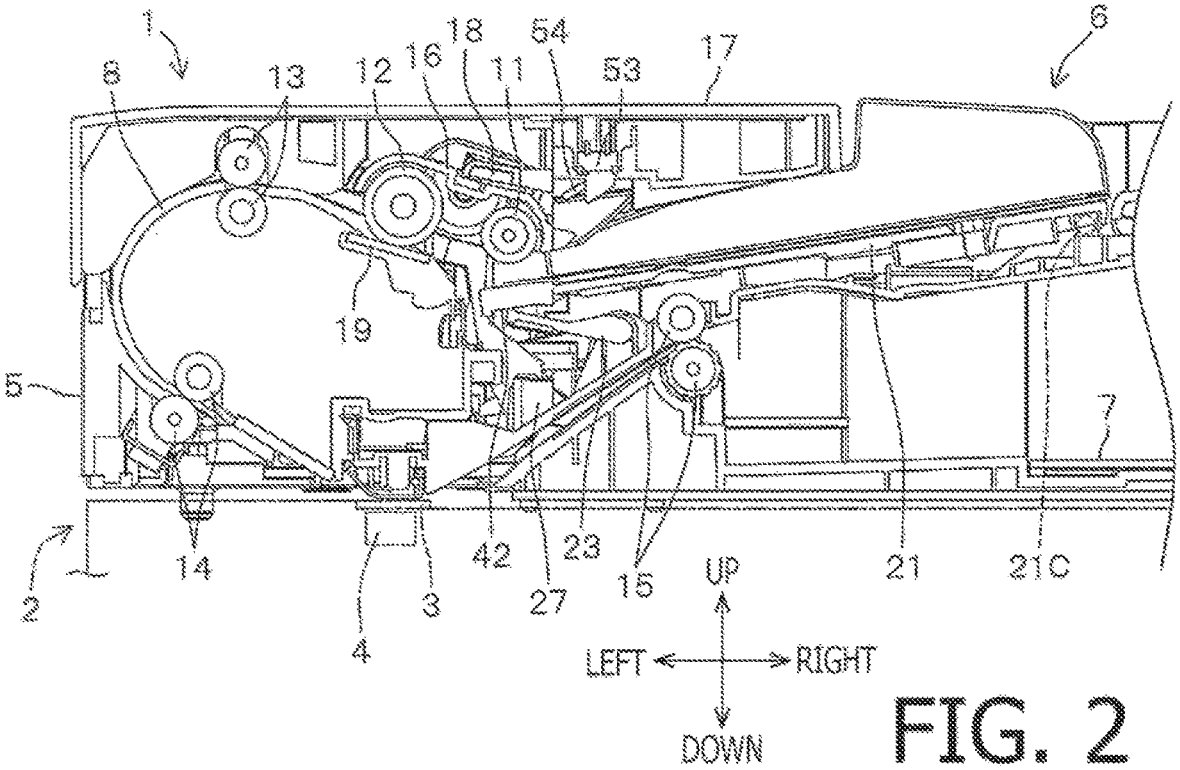
FIG. 2 is a cross-sectional view of the document feeder and indicates a state where the movable plate of the document tray is rotated upward from the starting position.
Figure 3:
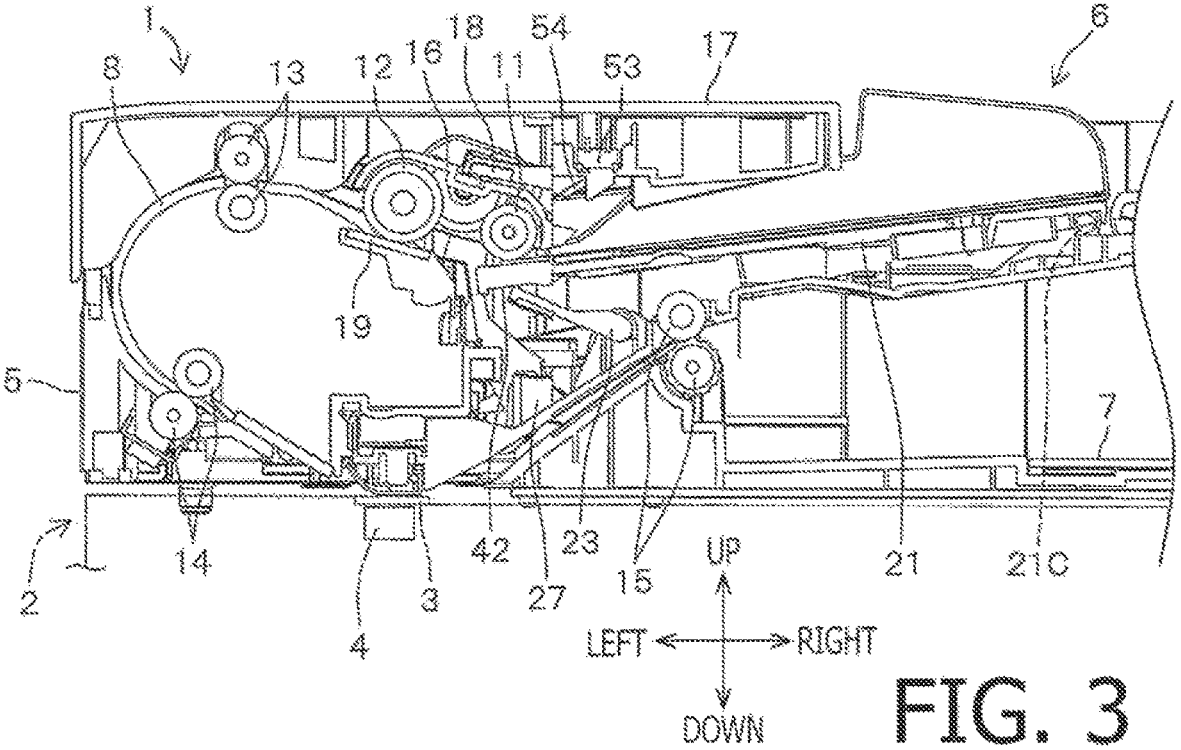
FIG. 3 is a cross-sectional view of the document feeder and indicates a state where the movable plate of the document tray is further rotated upward from the state indicated in FIG. 2.
Figure 4:
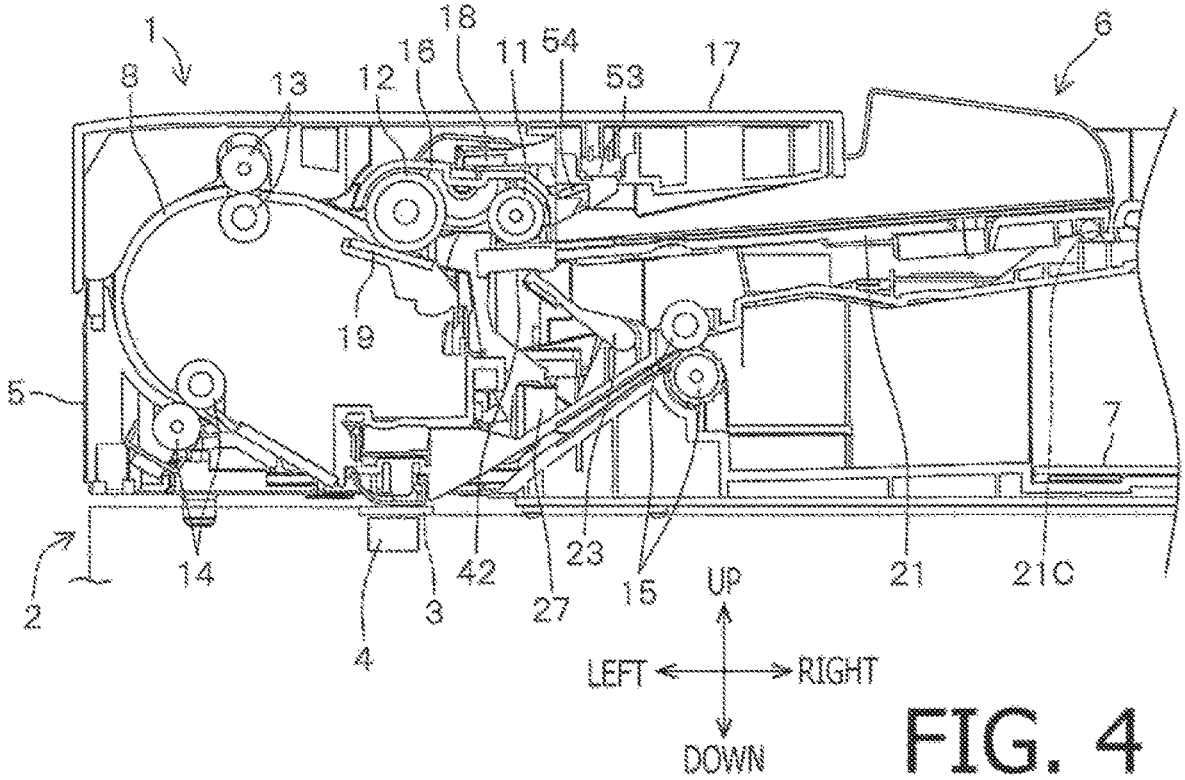
FIG. 4 is a cross-sectional view of the document feeder and indicates a state where the movable plate is in an upper limit position.

The document tray 6 is provided with a movable plate 21 (an example of a tray) having a substantially rectangular shape and arranged on an end portion of the conveying path 8. The movable plate 21 is configured such that one end edge thereof extends in the front-rear direction, and a tray shaft 21C (an example of a first shaft) is arranged along the one end edge. The movable plate 21 is swingably supported by the hosing 5 with the tray shaft 21C such that a leading edge of the movable plate 21, which is an edge on a left side with respect to the tray shaft 21C, is displaceable in the up-down direction. Given that a position of the movable plate 21 shown in FIG. 1 as a starting position (i.e., an initial position), the movable plate 21 is inclined downward to the left from the tray shaft 21C at the starting position. As the movable plate 21 swings, the leading edge of the movable plate 21 is lifted, passes through a position indicated in FIG. 2, and contacts the outer circumference of the pickup roller 11 as shown in FIG. 3. After contacting the outer circumference of the pickup roller 11, the movable plate 21 can further swing to an upper limit position which is shown in FIG. 4. The tray shaft 21C may be fixed to the housing 5.

Figure 5:
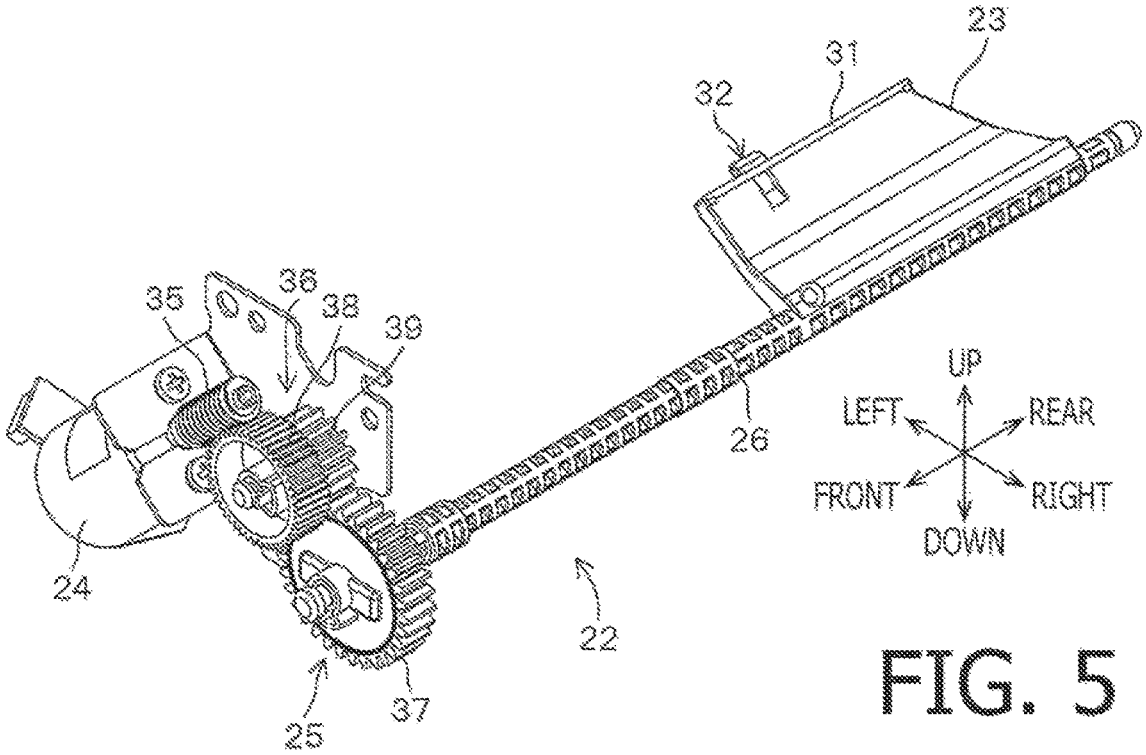
FIG. 5 is a perspective view of the tray swinging mechanism.

The document feeder 1 is provided with a swinging mechanism 22 (an example of a swing drive mechanism) shown in FIG. 5 in order to swing the movable plate 21 of the document tray 6 between the starting position and the upper limit position. The swinging mechanism 22 includes a lifter 23 (an example of a lever), a motor 24 (an example of a driving source) and a reduction mechanism 25.

Figure 6:
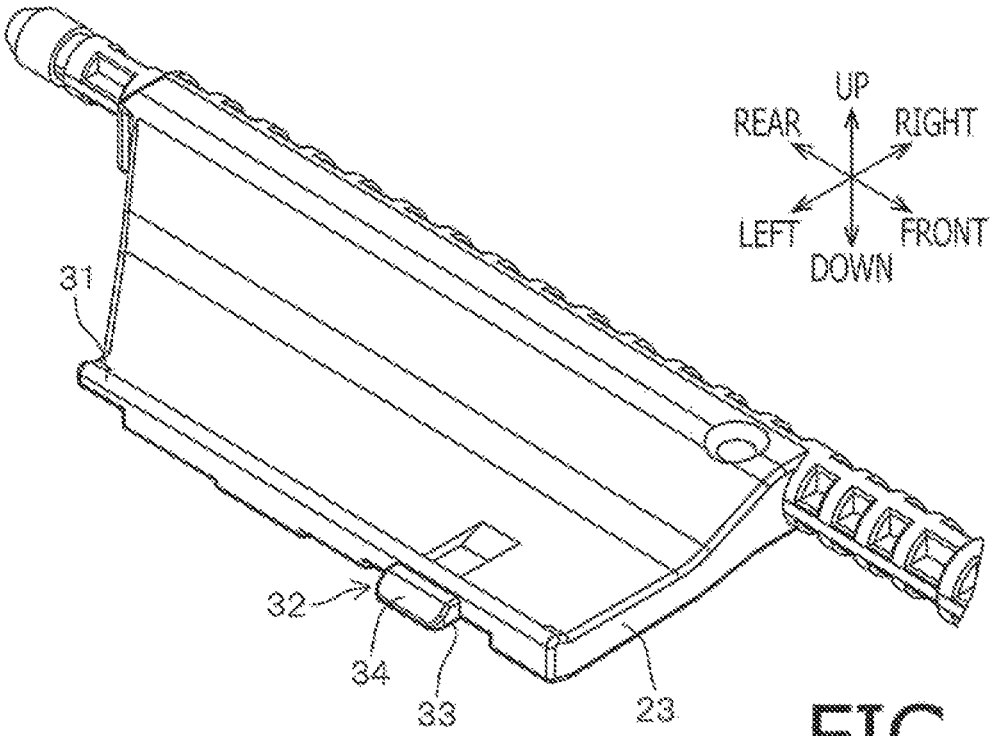
FIG. 6 is a perspective view of a lifter.

The lifter 23 is arranged under a left end part of the movable plate 21. The lifter 23 is swingably supported by the housing 5 with a lifter shaft 26. Specifically, the lifter 23 is formed integrally with the lifter shaft 26. The lifter shaft (an example of a second shaft) 26 is arranged to extend in the front-rear direction at a position different from the tray shaft 21C of the movable plate 21. Further, the lifter shaft 26 is rotatably supported by a supporting part (not shown) provided inside the housing 5. The lifter 23 protrudes leftward from a rear end of the lifter shaft 26. The lifter 23 has, as shown in FIG. 6, a substantially trapezoidal shape in which a width in the front-rear direction (i.e., an axial direction) is narrower at a position farther from the lifter shaft 26 than at a position closer to the lifter shaft 26.

A contacting part 31 is formed along an edge of the tip of the lifter 23 over the entire width of the tip. The contacting part 31 is a substantially semi-cylindrical part formed on the upper surface of the lifter 23 and has a circumferential surface which is a part of a cylindrical surface.

A claw part 32 is formed integrally with the tip of the lifter 23. The claw part 32 protrudes leftward from a position near the front side of the tip of the lifter 23. The claw part 32 has a wedge shape when viewed from the front side, and includes a planer surface 33 and an inclined surface 34. The planer surface 33 extends in a direction perpendicular to a front-end surface of the lifter 23, and the inclined surface 34 extends from a position, on the front-end surface, higher than the planer surface 33 toward a leading edge of the planer surface 33.

In the present embodiment, the motor 24 is a DC motor.

The reduction mechanism 25 includes, as shown in FIG. 5, a worm gear 35, a two-stage gear 36 and a lifter gear 37. The worm gear 35 is relatively unrotatably supported by a rotation shaft of the motor 24. The two-stage gear 36 includes a first gear 38 and a second gear 39 stacked in two stages. The first gear 38 is a worm wheel, which forms a worm gear mechanism configured to engage with the worm gear 35 and provides a large reduction ratio. The second gear 39 is a spur gear having a smaller diameter than the first gear 38. The lifter gear 37 is relatively unrotatably supported at a front-end part of the lifter shaft 26 and is engaged with the second gear 39. Thus, the reduction mechanism 25 can transmit a driving force of the motor 24 to the lifter gear 26 in a reduced manner.

As the driving force of the motor 24 is transmitted to the lifter shaft 26 via the reduction mechanism 25, and the lifter 23 swings in accordance with the rotation of the lifter shaft 26. When a rotation direction of the motor 24 is switched between a forward direction and a reverse direction, a rotation direction of the lifter shaft 26 is also switched, and the lifter 23 swings about the lifter shaft 26.

As can be understood with reference to FIGS. 1-4, when the movable plate 21 is located at the starting position, the lifter 23 extends downward to the left, and the contacting part 31 of the tip of the lifter 23 is spaced from the movable plate 21. A stopper 27 (an example of a restriction member) is provided below the tip of the lifter 23, and a lower surface of the tip of the lifter 23 contacts the stopper 27, thereby a further downward movement of the lifter 23 being restricted. When the lifter 23 swings from this state such that the tip of the lifter 23 is raised, the contacting part 31 of the tip of the lifter 32 contacts a lower surface of the movable part 21 on the way of its movement. Thereafter, the movable plate 21 is pushed by the lifter 32, and thereby the tip of the movable plate 21 is raised.

When the document sheets are supported on the movable plate 21, as the tip of the movable plate 21 is lifted, the uppermost document sheet contacts the circumference of the pickup roller 11. When the driving force of the motor 24 is further transmitted to the lifter 23 and the movable plate 21 is pushed by the lifter 23, the roller holder 16 swings about a shaft of the separating roller 12, thereby the pickup roller 11 is lifted with the shaft of the separating roller 12 as a fulcrum, the roller holder 16 approaches the cover 17. When the roller holder 16 approaches the cover 17 closer than a particular distance, a reaction force to move the roller holder 16 away from the cover 17 is applied from the elastic member 18 to the roller holder 16. Therefore, a contact force between the pickup roller 11 and the document sheets changes depending on the rotation amount of the motor 24 after the uppermost document sheet supported by the movable plate 21 contacts the circumference surface of the pickup roller 11, and a feeding pressure applied to the document sheets, when the pickup roller 11 is rotating, from the circumference of the pickup roller 11 changes.

The reduction mechanism 25 is designed such that the reduction ratio is equal to or more than 48. This design is made in consideration of characteristics of the motor 24 and the feeding pressure of the pickup roller 11. If the feeding pressure of the pickup roller 11 is too large, double feeding (i.e., feeding of multiple document sheets in an overlapped state) may occur. Further, in response to a stop instruction (described later) of the motor 24, the motor 24 idles, and then stops. That is, after supply of a drive current to the motor 24 is stopped, the motor 24 continues to rotate for a while due to inertia of a rotor in the motor 24. The idling of the motor 24 is the rotation movement due to the inertia after supply of a drive current to the motor 24 is stopped. For example, when the moving amount of the tip of the movable plate 21 during the idling (hereinafter, the moving amount will be referred to as an "idling distance") is more than 1 mm, the feeding pressure of the pickup roller 11 becomes too large, and the double feeding may occur. In order to suppress the idling distance to equal to or less than 1 mm, the reduction ratio of the reduction mechanism 25 should be equal to or more than 48. It is noted that, in order to prevent the double feeding accurately, it is preferable to set the idling distance to equal to or less than 0.5 mm and design the reduction mechanism 25 such that the reduction ratio is equal to or more than 93.

Figure 7:
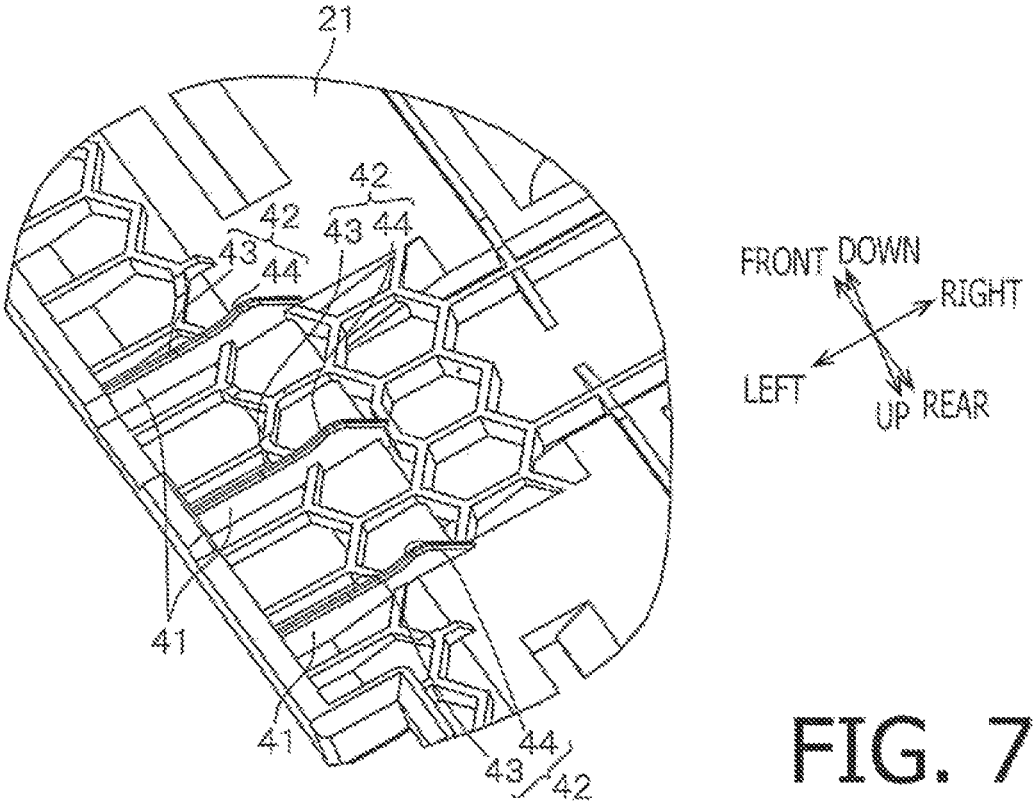
FIG. 7 is a perspective view of a part of a lower surface of the movable plate.
Figure 8:
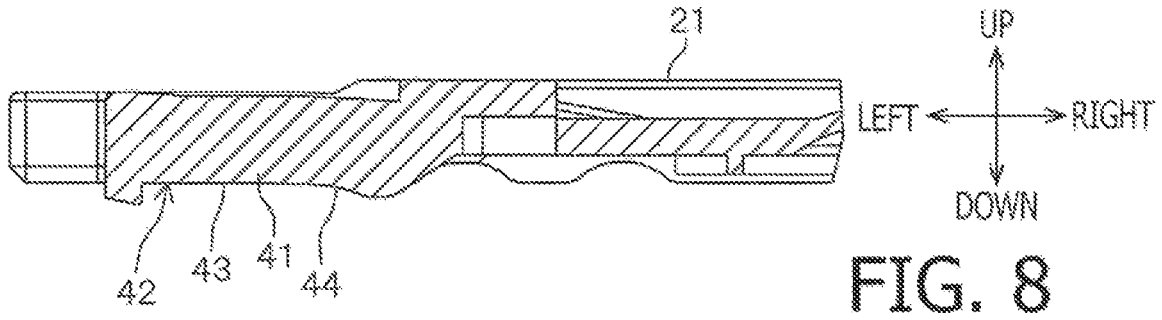
FIG. 8 is a cross-sectional view of the movable plate and indicates a shape of a cam surface.

As shown in FIG. 7, on a lower surface (an example a second surface) of the movable plate 21, multiple ribs 41, each extending in the right-left direction, are formed to protrude at a portion to which the contacting part 31 of the tip of the lifter 23 contacts. Multiple ribs 41 (three ribs in the present embodiment) are spaced in the front-rear direction. The contacting part 31 of the lifter 23 is arranged across the multiple ribs 41 in the front-rear direction and is configured to contact all of tip end surfaces of the multiple ribs 41. As shown in FIG. 8, the tip end surface of each of the ribs 41 is formed to be a cam surface 42 such that the moving amount of the tip of the movable plate 21 resulting from the swinging of the lifter 23 by a particular angle is constant regardless of the swinging position of the lifter 23. Specifically, a tip of an upper surface (an example of a first surface) of the movable plate 21 is formed to have a planer surface. Further, the tip end surface, which is the cam surface 42 of each rib 41, includes a parallel part 43 and a curved part 44. The parallel part 43 extends in the right-left direction in parallel with the upper surface of the movable plate 21, and the curved part 44 is formed to be farther from the upper surface of the movable plate 21 toward the right side.

Figure 9:
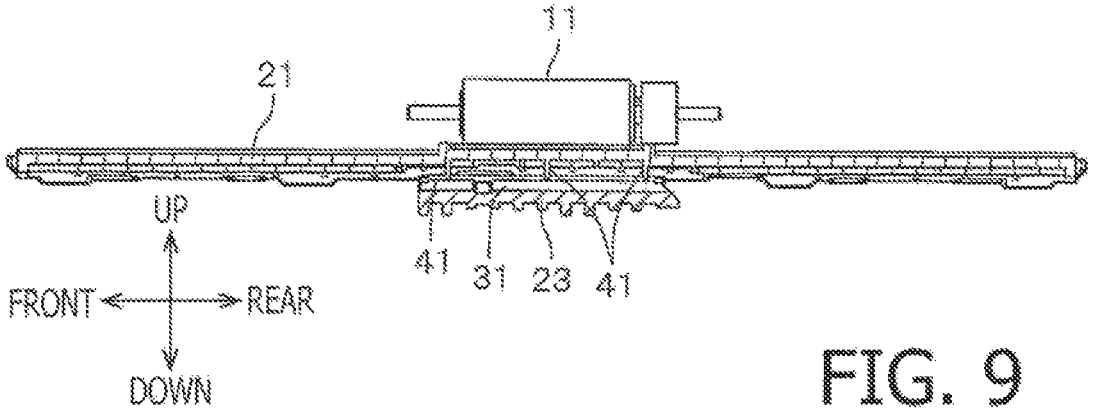
FIG. 9 is a cross-sectional view of a part of the document feeder and indicates a positional relationship between a pickup roller, ribs of the movable plate and a contacting part of the lifter.

Further, as shown in FIG. 9, the multiple ribs 41 are formed on a rear surface of a contacting part of the movable plate 21, which contacts the pickup roller 11. At least the central rib 41 among the multiple ribs 41 is arranged within a range where the pickup roller 11 extends in the front-rear direction. That is, when the pickup roller 11 is projected from the vertical direction onto a horizontal plane, at least the cam surface 42 of the central rib 41 is positioned within the projected area of the pickup roller 11. It is noted that the number of ribs 41 are not limited to three, and at least one (e.g., a single) rib 41 may be formed on the rear surface.

Detection of Tray Position

The document feeder 1 is provided with a mechanism used to detect a position of the movable plate 21.

Figure 10A:
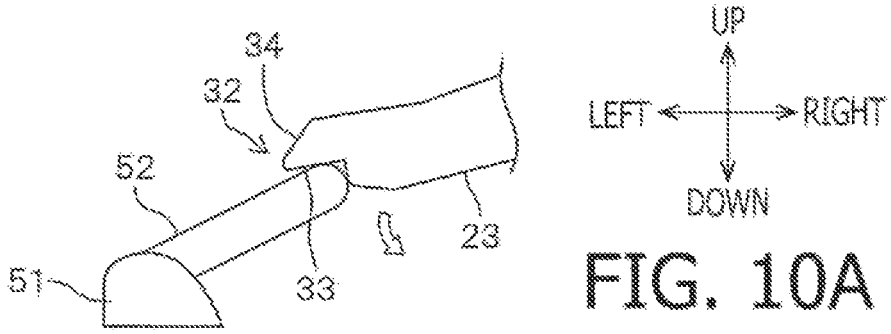
FIG. 10A is an illustrative drawing indicating a configuration of a starting position sensor and indicates a state where the movable plate is located at the starting position.
Figure 10B:
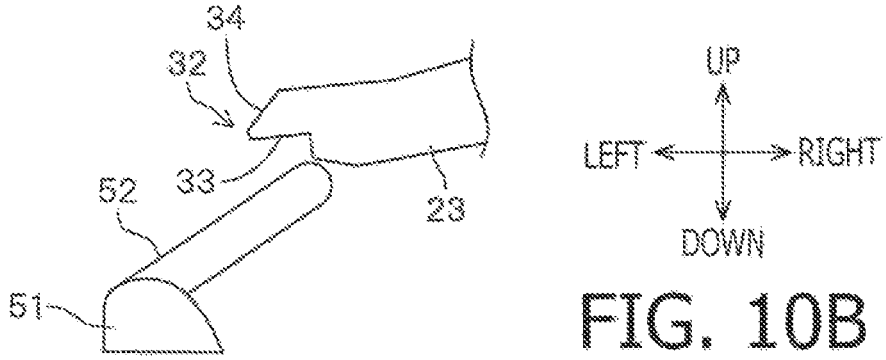
FIG. 10B is an illustrative drawing indicating a configuration of the starting position sensor and indicates a state where the lifter is separated away from an actuator.

Specifically, the document feeder 1 is provided with a starting position sensor (an example of a lower position sensor) 51 used to detect the starting position of the movable plate 21. As shown in FIGS. 10A and 10B, the starting position sensor 5 includes an actuator 52 configured to be displaced as the claw part 32 of the tip of the lifter 23 contacts. That is, the starting position sensor 52 is arranged such that a part of a movable range of the actuator 52 overlaps a part of a movable range of the claw part 32 of the lifter 23.

When the lifter 23 is positioned in the starting position, as shown in FIG. 10A, the actuator 52 is pressed by the planer surface 33 of the claw part 32. In this state, the actuator 52 is outputting a detection signal. When the lifter 23 swings upward, as shown in FIG. 10B, the planer surface 33 of the claw part 32 is separated from the actuator 52. In this state, the actuator 52 is not outputting the detection signal.

The document feeder 1 is provided with a feeding position sensor 53 used to detect a feeding position of the movable plate 21. The feeding position sensor 53 is arranged on a lower surface (a back surface) of the cover 17 as shown in FIGS. 1-4, and includes an actuator 54 configured to be displaced as the roller holder 16 contacts, as shown in FIG. 4. That is, the feeding position sensor 53 is arranged such that a part of a movable range of the actuator 54 overlaps a part of a movable range of the roller holder 16.

As described above, after the tip of the movable plate 21 is lifted by the lifter 23 and the uppermost document sheet supported on the movable plate 21 contacts the circumference of the pickup roller 11, when the movable plate 21 is pressed by the lifter 23, the pickup roller 11 is lifted with a shaft of the separating roller 12 as a fulcrum, and thereby the roller holder 16 swings. When the roller holder 16 swings by a particular amount, a right end part of the roller holder 16 contacts the actuator 54. When the roller holder 16 further swings and the actuator 54 is moved as pressed by the roller holder 16, the feeding position sensor 53 outputs the detection signal.

Electrical Configuration of Document Feeder

Figure 11:
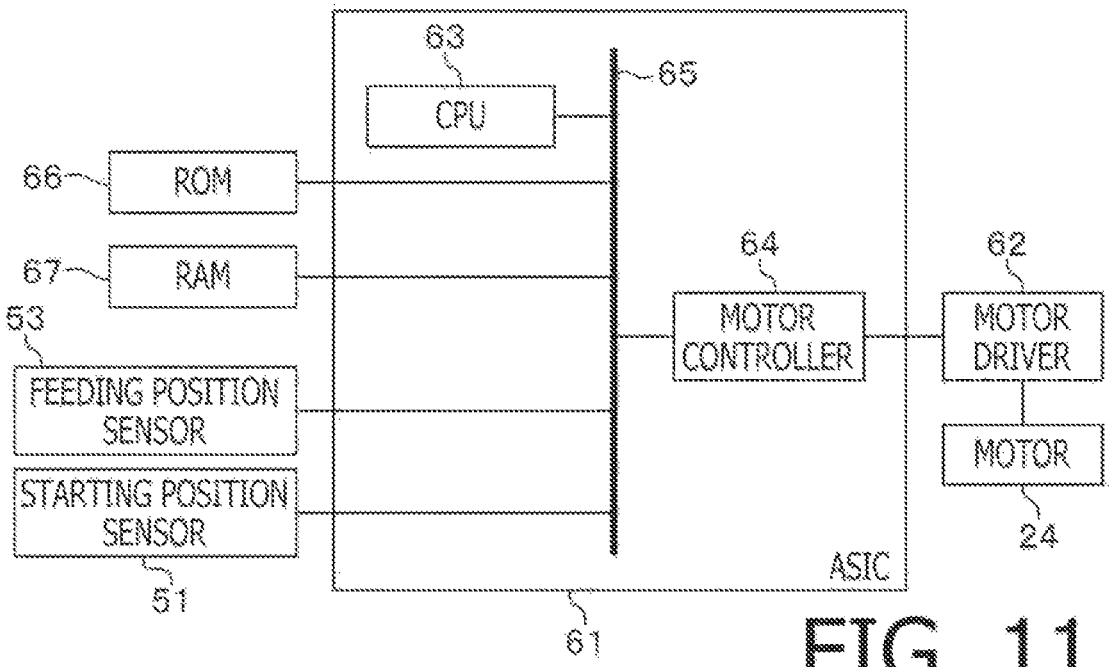
FIG. 11 is a block diagram indicating an electrical configuration of the document feeder.
Figure 12:
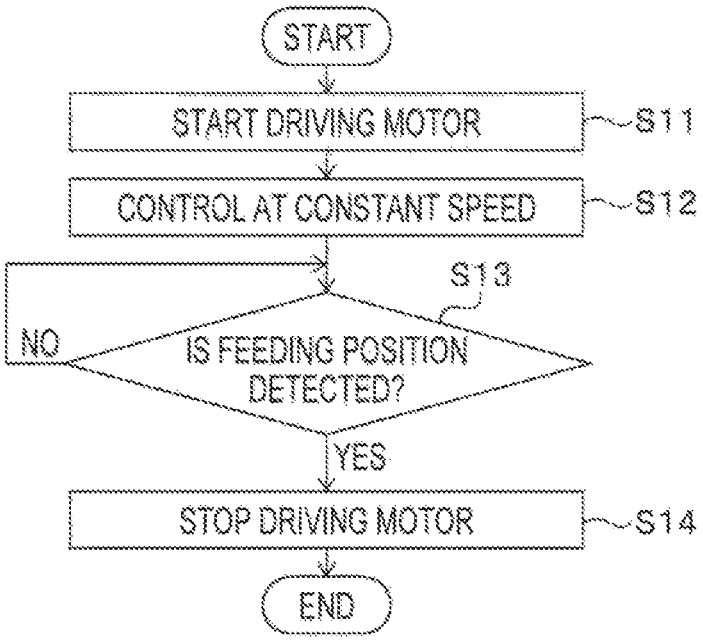
FIG. 12 is a flowchart illustrating an initial operation.

As shown in FIG. 11, the document feeder 1 is provided with an ASIC (Application Specific Integrated Circuit) 61 configured to control each part of the document feeder 1. Further, the document feeder 1 is provided with a motor driver 62 configured to drive the motor 24.

The ASIC 61 (an example of a controller) includes a CPU 63 configured to perform arithmetic processing, and a motor controller 64 configured to output a PWM (Pulse Width Modulation) signal to the motor driver 62 in accordance with an instruction from the CPU 63. The CPU 63 and the motor controller 64 are communicably connected to an internal bus 65 in the ASCI 61.

To the internal bus 65, a ROM 66 and a RAM 67, which are provided outside the ASIC 61, are connected. The ROM 66 is a rewritable non-volatile memory such as a flash memory, and stores a program to be executed by the CPU 63 and various types of data. The RAM 67 is a volatile memory such as a DRAM (Dynamic Random Access Memory) and used as a work area when the CPU 63 executes the program. Further, the starting position sensor 51 and the feeding position sensor 53 are connected to the internal bus 65, and the detection signal from each of the starting position sensor 51 and the feeding position sensor 53 is transmitted through the internal bus 65.

The motor driver 62 is a general-purpose driver including an H-bridge circuit. When the PWM signal is input from the motor controller 64 to the motor driver 62, an ON/OFF state of a switching element constituting the H-bridge circuit is switched in accordance with the PWM signal, thereby a driving current supplied from the motor driver 62 to the motor 24 being changed. In order to control an angular speed (i.e., rotation speed) of the motor 24 is controlled by the driving current supplied to the motor 34, the motor 24 is provided with a well-known rotary encoder, an encoder signal is transmitted through the internal bus 65 of the ASIC 61.

Initial Operation

When the document sheets are not supported by the document tray 6, the movable plate 21 is located at the starting position. When the document sheets are placed on the document tray 6, the CPU 63 executes an initial operation process to rotate the movable plate 21 from the starting position to the feeding position.

In the initial operation process, the CPU 63 inputs an instruction to start supplying a driving current to the motor 24. In response to the instruction, the PWM signal is output from the motor controller 64 to the motor driver 62, and the driving current is started to be supplied from the motor driver 62 to the motor 24 (S11).

Then, the CPU 63 sets an angular speed of the motor 24 to a constant angular speed and inputs, to the motor controller 64, an instruction to rotate the motor 24 at the constant angular speed. In response to the instruction, the motor controller 64 executes a feedback control of a duty ratio of the PWM signal based on an encoder signal input from the rotary encoder so that the angular speed of the motor 24 coincides with the constant angular speed. Accordingly, the motor 24 is controlled at a constant speed (S12), and the tip of the lifter 23 is lifted at a constant speed. When the contacting part 31 of the lifter 23 contacts the cam surface 42 and the contacting part 31 slidably moves on the cam surface 42, the tip of the lifter 23 is lifted at a constant speed. Accordingly, the tip of the movable plate 21 is lifted at a constant speed.

Thereafter, the CPU 63 determines whether the detection signal of the feeding position sensor 53 is input (S13). When the document sheets supported by the movable plate 21 lift the pickup roller 11, the roller holder 16 is swung and the actuator 54 of the feeding position sensor 53 is moved, thereby feeding position sensor 53 outputting the detection signal.

When determining that the detection signal of the feeding position sensor 53 is input to the CPU 63 (S13: YES), the CPU 63 transmits, to the motor controller 64, an instruction to stop supplying the driving current to the motor 24. In response to the instruction, the motor controller 64 is controlled to stop outputting the PWM signal to the motor driver 62, and the supplying of the driving current from the motor driver 62 to the motor 23 is stopped (S14). As a result, the motor 24 is stopped, and the lifter 23 and the movable plate 21 are stopped.

Process During Document Feeding

Figure 13:
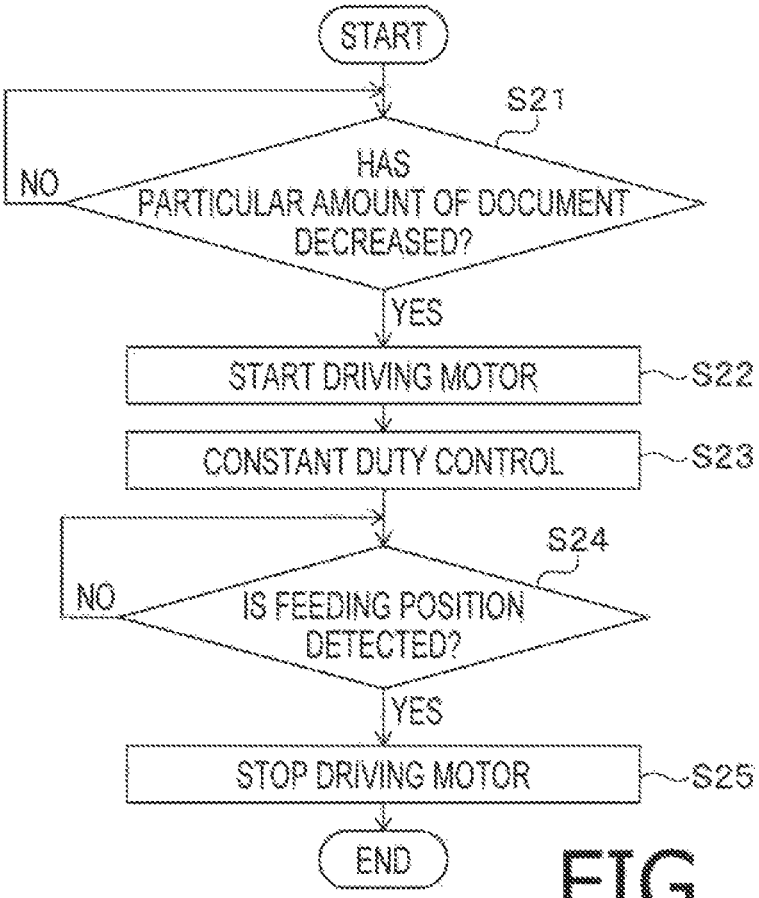
FIG. 13 is a flowchart illustrating an operation during document feeding.

After the initial operations process, the CPU 63 executes a process during document feeding shown in FIG. 13.

When the document sheets supported on the document tray 6 are fed, and the number of the document sheets on the document tray 6 decreases, the roller holder 16 is rotated and is moved away from the actuator 54 of the feeding sensor 53 by a reaction force applied from the elastic member 18 to the roller holder 16. When the number of the document sheets supported by the document tray 6 decreases by a particular amount (S21: YES), the actuator 54 of the feeding position sensor 53 returns to an initial position and the feeding position sensor 53 stops outputting the detection signal.

The CPU 63 inputs an instruction to start outputting the PWM signal having a constant duty ratio to the motor controller 64 in response to the cessation of the output of the detection signal from the feeding position sensor 53. Then, the motor controller 64 inputs the PWM signal having the constant duty into the motor driver 62. Thus, the driving current in accordance with the constant duty ratio of the PWM signal is started to be supplied from the motor driver 62 to the motor 24 is started (S22).

Thereafter, until the feeding position sensor 53 outputs the detection signal again, the driving current is kept being supplied from the motor driver 62 to the motor 24 (S23: constant duty control).

When determining that the detection signal of the feeding position sensor 53 is input (S24: YES), the CPU 63 inputs, to the motor driver 64, an instruction to stop supplying the driving current to the motor 24. In response to the instruction, the driving current supplied from the motor driver 62 to the motor 24 is stopped (S25). As a result, the motor 23 is stopped, and the lifter 23 and the movable plate 21 are stopped.

End Operation Process

When the documents supported on the document tray 6 run out, the CPU 63 executes an end operation process to rotate the movable plate 21 from the feeding position to the starting position.

Figure 14:
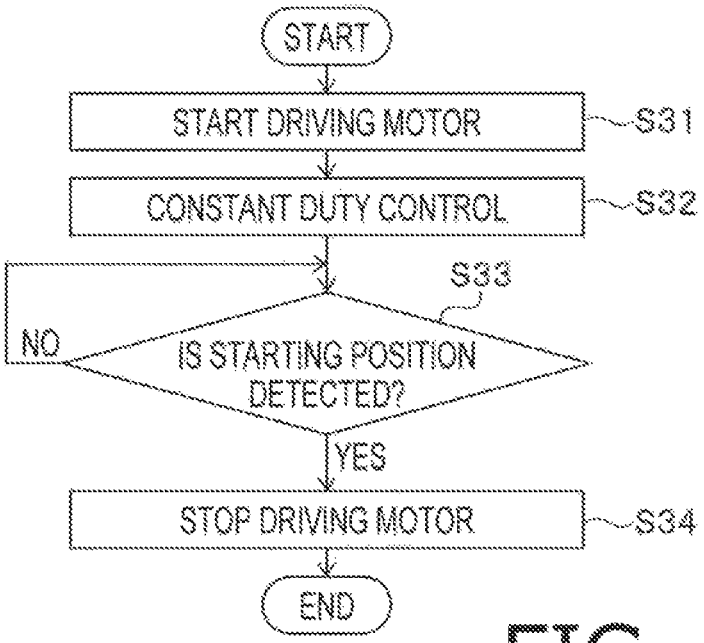
FIG. 14 is a flowchart illustrating an end operation.

In the end operation process, as shown in FIG. 14, the CPU 63 inputs, to the motor controller 64, an instruction to start outputting the PWM signal having the constant duty ratio. In response to the instruction, the motor controller 64 inputs the PWM signal having the constant duty ratio into the motor driver 62. Thus, the driving current in accordance with the duty ratio of the PWM signal from the motor driver 62 to the motor 24 is started to be supplied (S31).

Thereafter, until the starting position sensor 51 outputs the detection signal again, the motor driver 62 continues to supply the driving current to the motor 24 in accordance with the constant duty ratio of the PWM signal (S32: constant duty ratio control).

Then, when determining that the detection signal of the starting position sensor 51 is input (S33: YES), the CPU 63 inputs, to the motor controller 64, an instruction to stop the supplying of the driving current to the motor 24. In response to the instruction, the output of the PWM signal from the motor controller 64 to the motor driver 62 is stopped, and the supplying of the driving current from the motor controller 64 to the motor 24 is stopped (S34). Thus, the motor 24 is stopped, and movements of the lifter 23 and the movable plate 21 are stopped. Although the actuator 52 drops slightly from a position where the detection signal is output to a position where it actually stops, the drop range is set within an allowable value of overtravel of the starting sensor 51 by the deceleration mechanism 25.

Effects

As described above, the movable plate 21 of the original tray 6, on which the document sheets are stacked, is configured to be swingable about the tray shaft 21C extending in the front-rear direction. The movable plate 21 extends leftward from the tray shaft 21C. The lifter 23 is configured to be swingable about the lifter shaft 26, which is arranged at a position different from the tray shaft 21C and extends in the front-rear direction. On the lower surface of the movable plate 21, the cam surface 42 to which the tip of the lifter 23 contacts is formed. The cam surface 42 includes the parallel part 43 and the curved part 44. The parallel part 43 is parallel to the upper surface of the movable plate 21. The curved part 44 extends rightward from the parallel part 43 continuously and is curved such that the curved part 44 is spaced from the upper surface of the movable plate 21 farther toward a right side. According to the shape of the cam surface 42, as the lifter 23 is swung by a particular constant angle, the tip of the movable plate 21 moves up by a particular constant amount. Thus, it is possible to keep a contacting pressure between the document sheets stacked on the movable plate 21 and the pickup roller 11 constant regardless of the swing position of the lifter 23. As a result, it is possible to feed the document sheets stably from the movable plate 21 by the pickup roller 11.

Further, since the cam surface 42 is arranged within a range where the pickup roller 11 extends in the axial direction of the tray shaft 21C, the pickup roller 11 can receive load input from the lifter 23 to the cam surface 42. Furthermore, the position to which the load for swinging the movable plate 21 is applied is only a part where the lifter 23 and the cam surface 42 contact each other. Therefore, the movable plate 21 is not likely to be deformed even in the long term.

Thus, it is possible to keep the moving amount of the movable plate 21 constant, and suppress the deformation of the movable plate 21.

Further, the tray shaft 21C of the movable plate 21 is arranged on a right side with respect to the tip of the movable plate 21, and the lifter shaft 26 of the lifter 23 is arranged on a right side with respect to the tip of the lifter 23. That is, both the tray shaft 21C of the movable plate 21 and the lifter shaft 26 of the lifter 23 are arranged on a right side with respect to the tip of the movable plate 21. Therefore, a left space with respect to the original tray 6 is not blocked by the lifter 23, and it is possible to use the space for arranging other components.

The cam surface 42 includes the tip end surfaces of the ribs 41 protruded downward from the lower surface of the movable plate 21, and multiple ribs 41 are formed on the lower surface of the movable plate 21. The contacting part 31 at the tip of the lifter 23, which is configured to contact the cam surface 42, contacts the multiple ribs 41 with straddling the multiple ribs 41. Therefore, it is possible to press the movable plate 21 stably by the contacting part 31 of the lifter 23, and rotate the movable plate 21 smoothly.

The contacting part 31 has a cylindrical surface shape at a part contacting the cam surface 42. Therefore, when the lifter 23 swings, it is possible to slidably move the contacting part 31 on the cam surface 42 smoothly. Thus, it is possible to swing the lifter 23 smoothly.

When the pickup roller 11 is projected from the vertical direction onto a horizontal plane, at least the cam surface 42 of the central rib 41 is positioned within the projected area of the pickup roller 11. Therefore, a pressing force (load) applied to the movable plate 21 from the lifter 23 can be effectively used for the contacting force between the pickup roller 11 and the document sheets stacked on the movable plate 21. Thus, a conveying characteristic of the document sheets by the pickup roller 11 is improved.

The lifter 23 is configured to contact the stopper 27, which restricts the downward movement of the lifter 23. Therefore, it is possible to prevent the actuator 52 from being pressed down beyond the allowable value for over traveling.

Modifications

Although one embodiment according the present disclosures is described above, aspects of the present disclosures can be implemented in other form, and various design modifications of the above embodiment can be realized within departing a scope of the claims.

What is claimed is:

1. A tray swinging mechanism provided to a device having a main body, a tray, and a pickup roller, the tray being swingably supported by the main body with a first shaft, the tray extending from the first shaft toward a downstream side in a conveying direction which is perpendicular to the first shaft, the tray having a first surface on which document sheets are stacked and a second surface which is a surface opposite to the first surface, and the pickup roller being configured to contact the document sheets stacked on the tray to feed the document sheets toward the downstream side in the conveying direction, wherein the tray swinging mechanism comprises:

a lever swingably supported by the main body with a second shaft extending parallelly to the first shaft at a position different from a position of the first shaft; and a driving source configured to generate a driving force to swing the lever, wherein the tray includes at least one cam surface formed on the second surface, the at least one cam surface being configured to contact a tip of the lever, wherein the at least one cam surface is formed such that, at every swinging movement of the lever by a particular constant angle, a moving amount of a tip of the tray is constant when the lever is swung by a particular angle, the at least one cam surface being arranged within a range where the pickup roller extends in an axial direction of the first shaft, and wherein the at least one cam surface includes:

a parallel part parallel to the first surface of the tray; and a curved part extending to an upstream side from the parallel part continuously in the conveying direction, the curved part being spaced from the first surface farther toward the upstream side, the parallel part and the curved part configured to contact the tip of the lever.

2. The tray swinging mechanism according to claim 1, wherein the second shaft is arranged at an upstream side with respect to the tip of the lever in the conveying direction.

3. The tray swinging mechanism according to claim 1, wherein the at least one cam surface is formed on a tip end surface of a rib protruded from the second surface of the tray, the rib having a plate shape extending in the conveying direction in a plane perpendicular to the second surface.

4. The tray swinging mechanism according to claim 3, wherein multiple ones of the rib protrude from the second surface of the tray, the multiple ribs being arranged in the axial direction of the first shaft, and the at least one cam surface being formed on a tip end surface of each of the multiple ribs.

5. The tray swinging mechanism according to claim 4, wherein, when the pickup roller is projected from a vertical direction onto a horizontal plane, a contacting part between the lever and the at least one cam surface is positioned within an area on which the pickup roller is projected.

6. The tray swinging mechanism according to claim 1, wherein the tip of the lever has a semi-cylindrical surface with a cylindrical axis parallel to the second shaft, the semi-cylindrical surface being configured to contact the at least one cam surface.

7. The tray swinging mechanism according to claim 1, further comprising a controller, wherein, every time a number of the document sheets supported by the first surface of the tray decreases by a particular amount, the controller drives the driving source to swing the lever by a particular angle and stops driving of the driving source after the lever is swung by the particular angle.

8. The tray swinging mechanism according to claim 7, further comprising a lowermost position sensor configured to detect the tray positioned in a lowermost position, the lowermost position sensor being configured to output a detection signal to the controller, wherein a lowermost detector configured to contact an actuator of the lowermost position sensor is provided at the tip of the lever.

9. The tray swinging mechanism according to claim 1, further comprising a stopper configured to contact the lever to restrict the lever from being moved downward.

10. The tray swinging mechanism according to claim 1, wherein the at least one cam surface includes a plurality of cam surfaces arranged within the range where the pickup roller extends in the axial direction of the first shaft.

11. A device comprising:

a main body;

a tray being swingably supported by the main body with a first shaft, the tray extending from the first shaft toward a downstream side in a conveying direction which is perpendicular to the first shaft, the tray having a first surface on which document sheets are stacked and a second surface which is a surface opposite to the first surface;

a pickup roller configured to contact the document sheets stacked on the tray to feed the document sheets toward the downstream side in the conveying direction;

a lever swingably supported by the main body with a second shaft extending parallelly to the first shaft at a position different from a position of the first shaft; and a driving source configured to generate a driving force to swing the lever, wherein the tray includes at least one cam surface formed on the second surface, the cam surface being configured to contact a tip of the lever, wherein the at least one cam surface is formed such that, at every swinging movement of the lever by a particular constant angle, a moving amount of a tip of the tray is constant when the lever is swung by a particular angle, the at least one cam surface being arranged within a range where the pickup roller extends in an axial direction of the first shaft, and wherein the at least one cam surface includes:

a parallel part parallel to the first surface of the tray; and a curved part extending to an upstream side from the parallel part continuously in the conveying direction, the curved part being spaced from the first surface farther toward the upstream side, the parallel part and the curved part configured to contact the tip of the lever.

* * * * *